US011896178B2

(12) United States Patent
Zhang et al.

(10) Patent No.: US 11,896,178 B2
(45) Date of Patent: Feb. 13, 2024

(54) CLEANING ASSEMBLY AND CLEANING ROBOT

(71) Applicants: Yunjing Intelligence Innovation (Shenzhen) Co., Ltd., Guangdong (CN); Yunjing Intelligence (Shenzhen) Co., Ltd., Guangdong (CN)

(72) Inventors: Junbin Zhang, Shenzhen (CN); Weijing Lin, Shenzhen (CN); Xingyan Li, Shenzhen (CN)

(73) Assignees: Yunjing Intelligence Innovation (Shenzhen) Co., Ltd., Shenzhen (CN); Yunjing Intelligence (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 18/162,788

(22) Filed: Feb. 1, 2023

(65) Prior Publication Data

US 2023/0172418 A1 Jun. 8, 2023

Related U.S. Application Data

(62) Division of application No. 17/589,058, filed on Jan. 31, 2022, now Pat. No. 11,612,296.

(30) Foreign Application Priority Data

Feb. 10, 2021 (CN) ..... 202110187167.3
Sep. 30, 2021 (CN) ..... 202122404309.5

(51) Int. Cl.
*A47L 11/40* (2006.01)
*A47L 11/282* (2006.01)

(52) U.S. Cl.
CPC ..... *A47L 11/4069* (2013.01); *A47L 11/282* (2013.01); *A47L 11/4038* (2013.01); *A47L 11/4055* (2013.01); *A47L 2201/00* (2013.01)

(58) Field of Classification Search
CPC .. A47L 11/282; A47L 11/283; A47L 11/4038; A47L 11/4055; A47L 11/4069; A47L 2201/00
See application file for complete search history.

(56) References Cited

U.S. PATENT DOCUMENTS 2,930,056 A * 3/1960 Lappin ..... A47L 11/4069 15/49.1
3,460,184 A 8/1969 Dyer
(Continued)

FOREIGN PATENT DOCUMENTS

CN 103006153 A 4/2013
CN 206714711 U 12/2017
(Continued)

OTHER PUBLICATIONS

European Patent Office, European Search Report in European Patent Application No. 22154101.4 (dated Jul. 13, 2022).
(Continued)

*Primary Examiner* — Randall E Chin
(74) *Attorney, Agent, or Firm* — Leydig, Voit & Mayer, Ltd.

(57) ABSTRACT

A cleaning assembly for a cleaning robot is provided. The cleaning assembly includes a motor, a transmission mechanism coupled with the motor, and a cleaning device comprising a shaft having a first gear coupled with the transmission mechanism and a cleaning module mounted to an end of the shaft. The transmission mechanism is configured to drive the shaft to rotate through the first gear. The shaft is configured to move axially. The cleaning module is configured to clean a surface area.

20 Claims, 14 Drawing Sheets

(56) References Cited

U.S. PATENT DOCUMENTS

| | | | |
|---|---|---|---|
| 5,243,727 | A | 9/1993 | Tanaka et al. |
| 5,483,718 | A | 1/1996 | Blehert et al. |
| 5,867,864 | A | 2/1999 | Miller et al. |
| 6,530,102 | B1 | 3/2003 | Pierce et al. |
| 2003/0000549 | A1 | 1/2003 | Joynt et al. |
| 2019/0261826 | A1 | 8/2019 | Goff |
| 2020/0139561 | A1 | 5/2020 | Kim et al. |

FOREIGN PATENT DOCUMENTS

| | | | |
|---|---|---|---|
| CN | 208799170 | U | 4/2019 |
| CN | 209032139 | U | 6/2019 |
| CN | 209808233 | U | 12/2019 |
| CN | 110710932 | A | 1/2020 |
| DE | 4211789 | A1 | 10/1993 |
| EP | 0850010 | A1 | 7/1998 |
| EP | 1674013 | A1 | 6/2006 |
| EP | 3711649 | A1 | 9/2020 |
| JP | H0493054 | U | 8/1992 |
| JP | 10652753 | U | 7/1994 |
| JP | 2001112683 | A | 4/2001 |
| JP | 201071327 | A | 4/2010 |
| JP | 2010071327 | A | 4/2010 |
| JP | 2010194204 | A | 9/2010 |
| JP | 2018132088 | A | 8/2018 |
| JP | 3224007 | U | 11/2019 |
| KR | 100848568 | B1 | 7/2008 |
| KR | 1020190000892 | A | 1/2019 |
| KR | 1020190003776 | A | 1/2019 |
| WO | 9708984 | A1 | 3/1997 |
| WO | 2019233493 | A1 | 12/2019 |

OTHER PUBLICATIONS

European Patent Office, European Search Report in European Patent Application No. 22154103.0 (dated Jul. 13, 2022).

Japanese Patent Office, Notice of Rejection in Japanese Patent Application No. 2022-012791 (dated Jul. 12, 2022).

Japanese Patent Office, First Office Action in Japanese Patent Application No. 2022-012791 (dated Mar. 22, 2022).

* cited by examiner

CLEANING ASSEMBLY AND CLEANING ROBOT

CROSS-REFERENCE TO RELATED APPLICATIONS

This application is a divisional of U.S. application Ser. No. 17/589,058, filed on Jan. 31, 2022, which claims the benefit of priority to Chinese Patent Application No. 202110187167.3, filed on Feb. 10, 2021, and Chinese Patent Application No. 202122404309.5, filed on Sep. 30, 2021, the disclosures of which are hereby incorporated by reference in their entireties.

TECHNICAL FIELD

The present disclosure relates to the technical field of cleaning robots, and in particular to a cleaning assembly and a cleaning robot with the same.

BACKGROUND

With the development of science and technology, cleaning robots are increasingly used in people's lives. An existing cleaning robot includes a cleaning assembly such as a mopping assembly. The cleaning assembly includes a cleaning module by which the ground or other surfaces can be cleaned. However, the cleaning module of such a cleaning robot cannot be lifted or lowered relative to the main body of the cleaning robot, which is not conducive to improving the adaptability of the cleaning robot.

SUMMARY

One objective of the present disclosure is to provide a cleaning assembly and a cleaning robot having the cleaning assembly. The cleaning assembly has a cleaning module that may be lifted or lowered relative to a main body of the cleaning robot, thereby improving adaptability of the cleaning robot to the surface being cleaned.

Another objective of the present disclosure is to provide a cleaning robot whose cleaning module may be lifted or lowered relative to the main body of the cleaning robot, thereby improving the adaptability of the cleaning robot.

To achieve the above objectives, the present disclosure provides a cleaning assembly including a rotation drive motor, a rotation transmission mechanism and a cleaning device. The rotation transmission mechanism is connected with the rotation drive motor; the cleaning device includes a rotating shaft and a cleaning module, the rotating shaft is provided with a gear part, the cleaning module is connected at a lower end of the rotating shaft, the gear part is connected with the rotation transmission mechanism to rotate the rotating shaft; the cleaning device is configured to lift or lower in an axial direction of the rotating shaft, and the rotating shaft is configured to drive the gear part to move axially relative to the rotation transmission mechanism while the cleaning device is lifted or lowered.

In some embodiments, the gear part is fixedly connected to or integrally formed with the rotating shaft.

In some embodiments, the rotation transmission mechanism includes a transmission gear engaged with the gear part to rotate the cleaning device, and the gear part is configured to move axially relative to the transmission gear while the cleaning device moves.

In some embodiments, the transmission gear and the gear part are spur gears or helical gears.

In some embodiments, the transmission gear and the gear part are helical gears; the cleaning assembly further includes a lifting mechanism connected to the cleaning device and configured to lift the cleaning device; while the cleaning device is lifted up by the lifting mechanism, the transmission gear is in a locked state, the gear part keeps meshing with the transmission gear, and the gear part is rotated under a push of teeth of the transmission gear to adjust a lifting angle of the cleaning module.

In some embodiments, two said cleaning devices are arranged side by side, the gear part of one of the two said cleaning devices and a corresponding transmission gear are spur gears, and the gear part of the other of the two said cleaning devices and a corresponding transmission gear are helical gears; the cleaning assembly further includes a lifting mechanism connected to the cleaning devices and configured to lift the cleaning devices; while the two said cleaning devices are lifted up by the lifting mechanism, the transmission gears are in a locked state, the gear part that is a helical gear is rotated under a push of teeth of the transmission gear to adjust a lifting angle of a corresponding cleaning module.

In some embodiments, the transmission gear and the gear part are helical gears, the gear part is rotated and simultaneously moved axially under a rotation of the transmission gear.

In some embodiments, the transmission gear has first rotation direction in which the gear part may move downward and a second rotation direction in which the gear part may move upward; while the transmission gear rotates in the second rotation direction, the gear part is moved upward along the transmission gear to lift the cleaning device due to a meshing between the transmission gear and the gear part, and the gear part is rotated to adjust a lifting angle of the cleaning module; while the transmission gear stops rotating, a lifting state of the cleaning device is maintained due to the meshing between the transmission gear and the gear part.

In some embodiments, the cleaning assembly further includes a lower limiting structure for limiting a downward movement range of the gear part along the transmission gear.

In some embodiments, the transmission gear includes a first meshing area located at a lower part thereof and a second meshing area located above the first meshing area; while the cleaning device cleans a ground, the gear part is configured to mesh with the first meshing area to rotate the cleaning module; while the cleaning device is in a lifting state, the gear part is configured to move upward and mesh with the second meshing area.

In some embodiments, while the cleaning device cleans a ground, the gear part is configured to mesh with the transmission gear to rotate the cleaning module; while the cleaning device is in a lifting state, the gear part is configured to move upward to disengage from the transmission gear.

In some embodiments, an upper end of a tooth groove of the transmission gear is connected with a guide groove which is configured to guide teeth of the gear part to the tooth groove of the transmission gear while the cleaning device returns downward; and/or a lower end of a tooth groove of the gear part is connected with a guide groove which is configured to guide teeth of the transmission gear to the tooth groove of the gear part while the cleaning device returns downward.

In some embodiments, the cleaning assembly further includes a lifting mechanism connected with the cleaning device and configured to lift up the cleaning device.

In some embodiments, the cleaning assembly further includes a rotating separation base provided on the rotating shaft and a force applying mechanism for acting on the rotating separation base; wherein the force applying mechanism is configured to increase elastic potential energy due to an upward movement of the rotating separation base while the cleaning device is lifted up, and further configured to release the elastic potential energy on the rotating separation base to facilitate the cleaning device to return downward.

In some embodiments, the cleaning assembly further includes a force applying mechanism located between the rotating shaft and the cleaning module and configured to apply a downward force to the cleaning module.

In some embodiments, the force applying mechanism is an elastic force applying mechanism.

In some embodiments, the cleaning module is provided with a counterweight, and/or the cleaning module includes a turntable structure at least partially composed of heavy metals.

To achieve the above objectives, the present disclosure provides a cleaning robot including a main body and the aforementioned cleaning assembly, the cleaning assembly is configured on the main body, and the cleaning device is located at a bottom side of the main body and configured to lift or lower relative to the main body.

The cleaning device of the cleaning assembly of the present disclosure may be lifted or lowered in an axial direction of the rotating shaft, thus the cleaning module may be lifted or lowered relative to the main body of the cleaning robot, and therefore the adaptability of the cleaning robot is improved. In addition, in the cleaning assembly of the present disclosure, the gear part on the rotating shaft is driven by the rotation transmission mechanism, so that the rotating shaft and the cleaning device are rotated together. Compared with the way in which the gear directly drives the rotating shaft to rotate and the rotating shaft moves axially relative to the gear, there is no need for the rotating shaft in the present disclosure to have a high-precision polygonal cross section, which is convenient for processing and reducing processing costs.

BRIEF DESCRIPTION OF THE DRAWINGS

The accompanying drawings facilitate an understanding of the various embodiments of this disclosure.

DETAILED DESCRIPTION

The subject technology will be described in even greater details below based on the exemplary figures, but is not limited to the examples. All features described and/or illustrated herein can be used alone or in different combinations. The features and advantages of various examples will become apparent by reading the following detailed description with reference to the attached drawings which illustrate the following:

Referring to FIGS. 1-13, the present disclosure provides a cleaning assembly including a cleaning device 10/10', a mounting base 20/20', and a swing arm 30/30'. Specifically, the cleaning device 10/10' is movable in an axially direction (e.g., a vertical direction), and a positioning part 11/11' is provided on the cleaning device 10/10'; the mounting base 20/20' is located on one side of the cleaning device 10/10'; and the swing arm 30/30' has one end pivotally connected to the mounting base 20/20' and another end connected to the positioning part 11/11', and the swing arm is configured to swing with a vertical movement (i.e., an axial movement) of the positioning part 11/11'. Such a configuration is conducive to self-adaptive floating of the cleaning device 10/10', thereby improving the adaptability of a cleaning robot having the cleaning assembly.

FIGS. 1-6 disclose a cleaning assembly according to the first embodiment of the present disclosure.

In this embodiment, the positioning part 11 is slidably connected to the swing arm 30, and the vertical movement of the positioning part 11 and the swing movement of the swing arm 30 are mutually converted under a relative sliding action between the positioning part 11 and the swing arm 30. When the cleaning device 10 is applied with an upward force from an obstacle, the positioning portion 11 may slide relative to the swing arm 30, and the swing arm 30 may swing accordingly; otherwise, when the force disappears, the cleaning device 10 may return downward, and the swing arm 30 may swing back accordingly.

Figure 1:
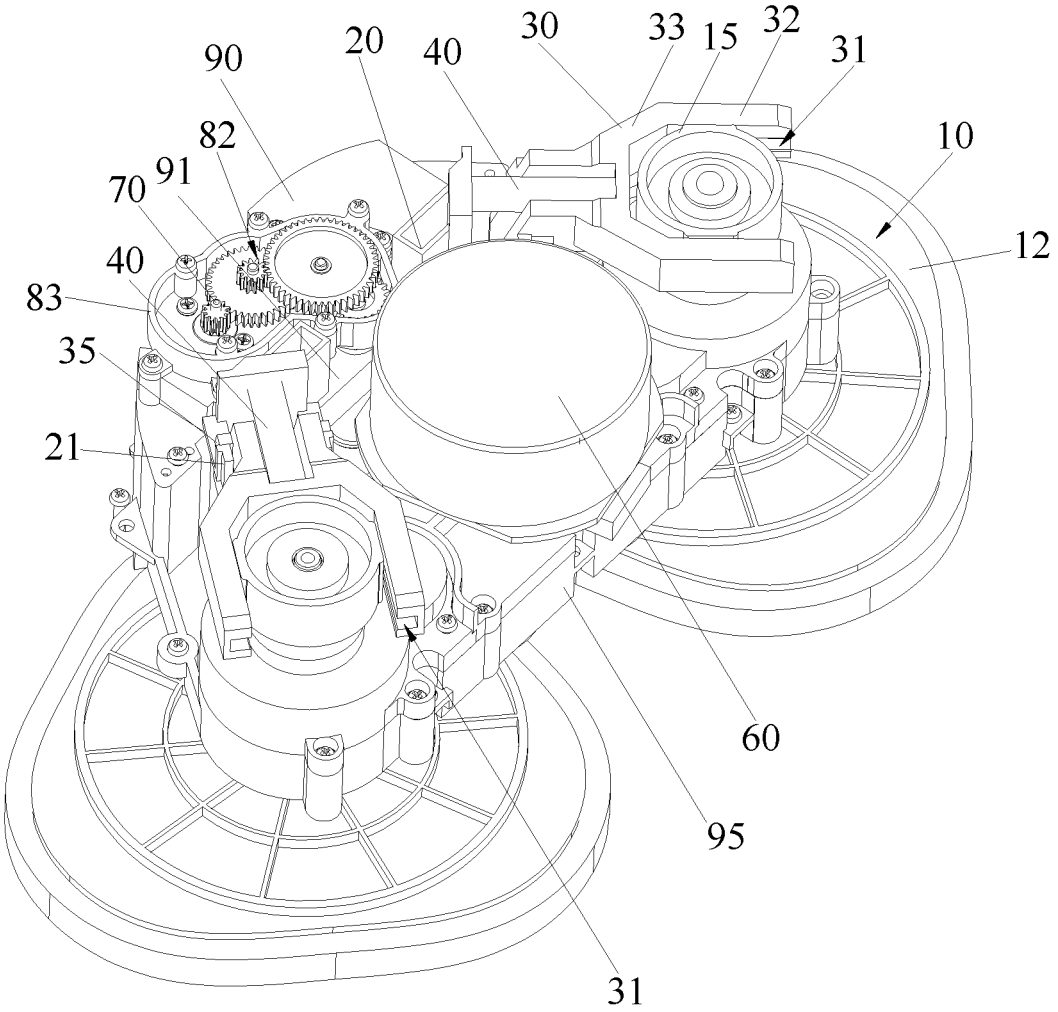
FIG. 1 is a perspective view of a cleaning assembly according to an embodiment of the present disclosure.
Figure 2:
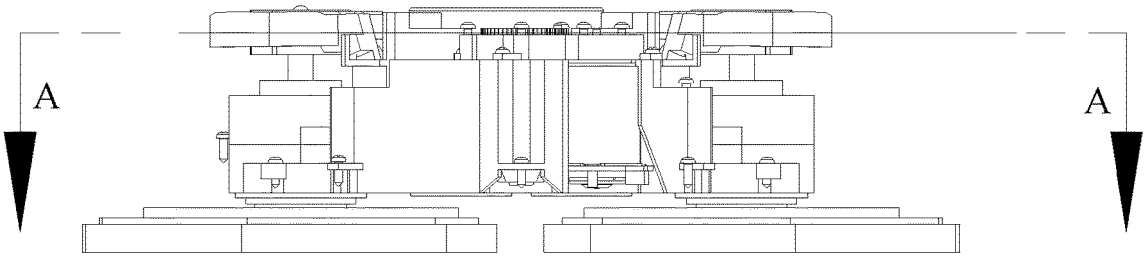
FIG. 2 is a side view of a cleaning assembly according to an embodiment of the present disclosure.
Figure 3:
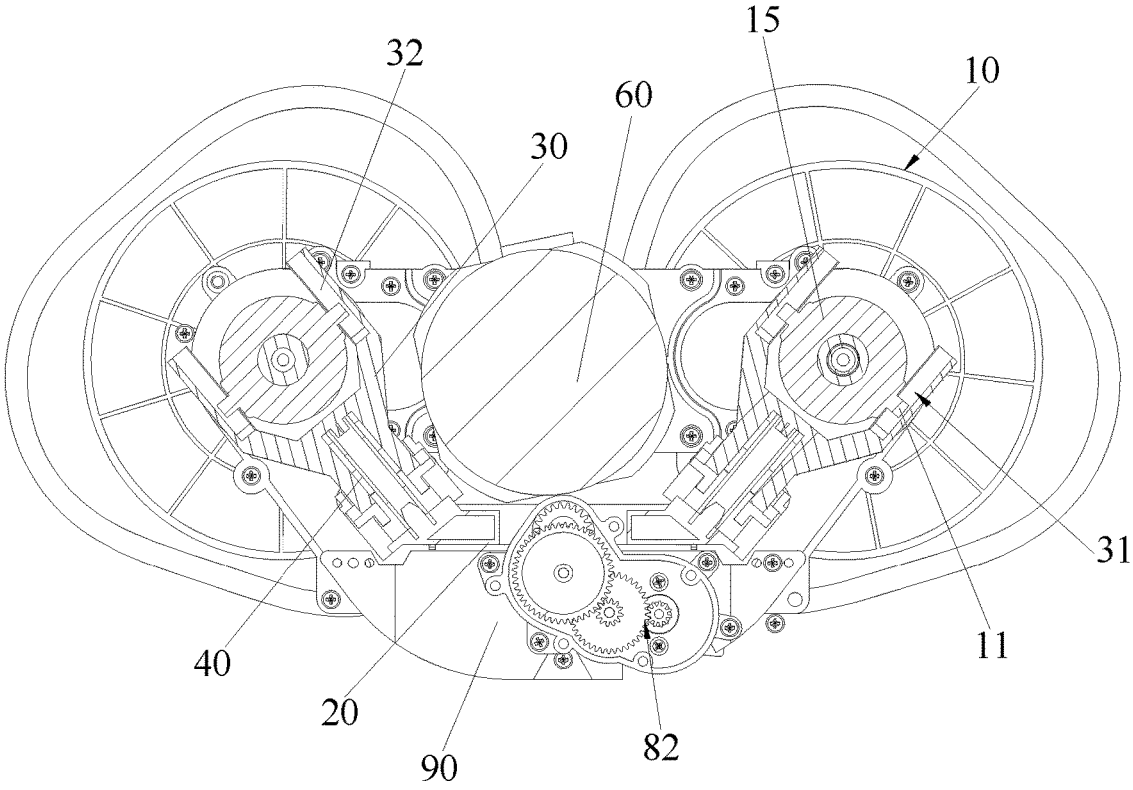
FIG. 3 is a cross-sectional view along line A-A of the cleaning assembly shown in FIG. 2 according to an embodiment.
Figure 4:
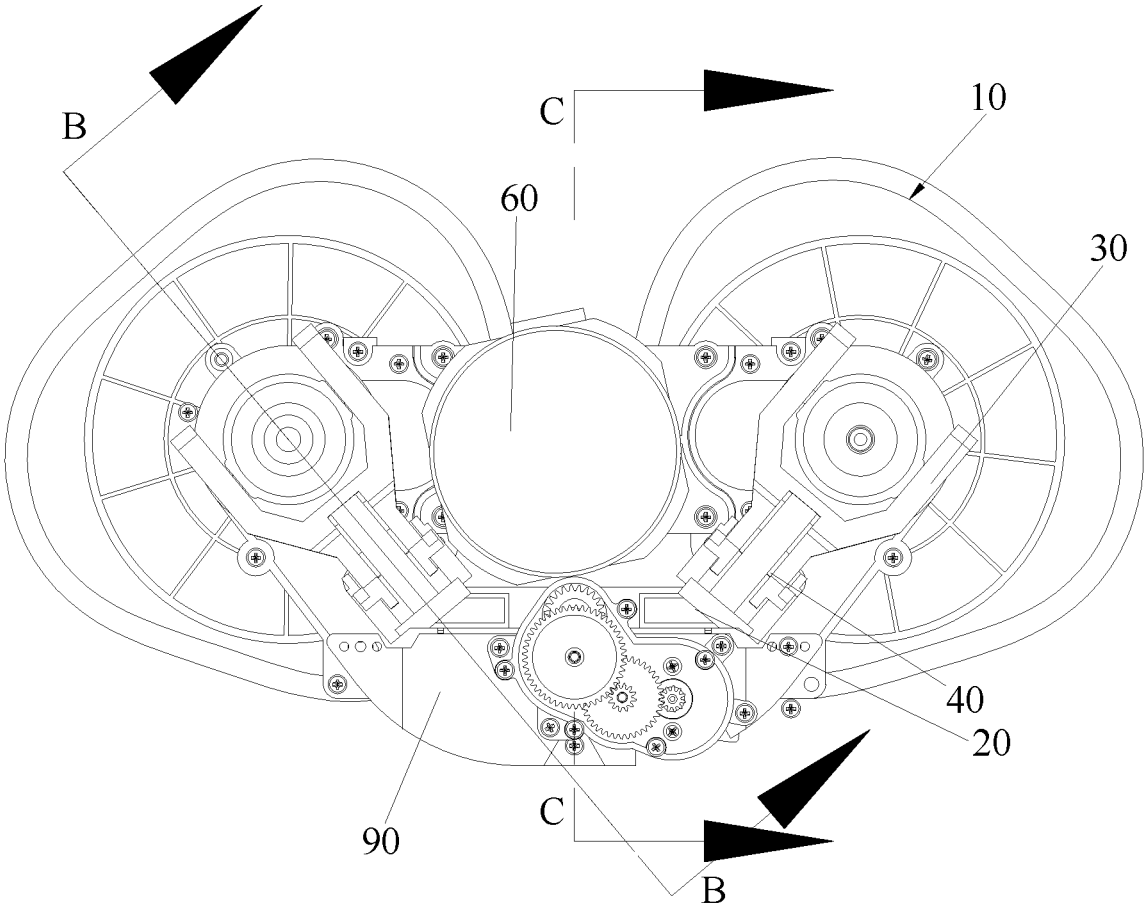
FIG. 4 is a top view of a cleaning assembly according to an embodiment of the present disclosure.

As shown in FIGS. 1 and 3, specifically, the swing arm 30 is provided with a sliding groove 31 in which the positioning part 11 is slidably configured, by means of a sliding action of the positioning part 11 in the sliding groove 31, the vertical movement of the positioning part 11 and the swing movement of the swing arm 30 may be mutually converted.

In order to achieve a more reliable engagement between swinging arm 30 and cleaning device 10, the swing arm 30 includes two arms 32 arranged opposite to each other, both arms 32 are respectively provided with a sliding groove 31, and the cleaning device 10 is provided with two said positioning parts 11 symmetrically arranged. Based on such a configuration, the two positioning parts 11 are correspondingly slidably arranged in the two sliding grooves 31.

In the present embodiment, the cleaning device 10 is configured to move upward to drive the swing arm 30 to swing through the positioning part 11 when applied with an upward force, and automatically return downward (by means of its own gravity, for example) once the upward force disappears. In such a way, the cleaning device 10 may achieve a self-adaptive floating.

In some embodiments, the cleaning assembly further includes an elastic force applying member. The elastic force applying member may store elastic potential energy when the cleaning device 10 is moved upward, and the cleaning device 10 may be returned downward under actions of a gravity of the cleaning device and a release of the elastic potential energy. Due to the existence of the elastic force applying member, the cleaning device 10 may achieve a stable self-adaptive floating.

Specifically, the elastic force applying member acts on the swing arm 30 in this embodiment, and the elastic force applying member is configured to store elastic potential energy when the cleaning device 10 is moved upward and release the elastic potential energy to facilitate a backswing of the swing arm 30 thereby facilitating the return of the cleaning device 10. Of course, the elastic applying member may not only act on the swing arm 30, but also directly act on the cleaning device 10 for example.

Figure 5:
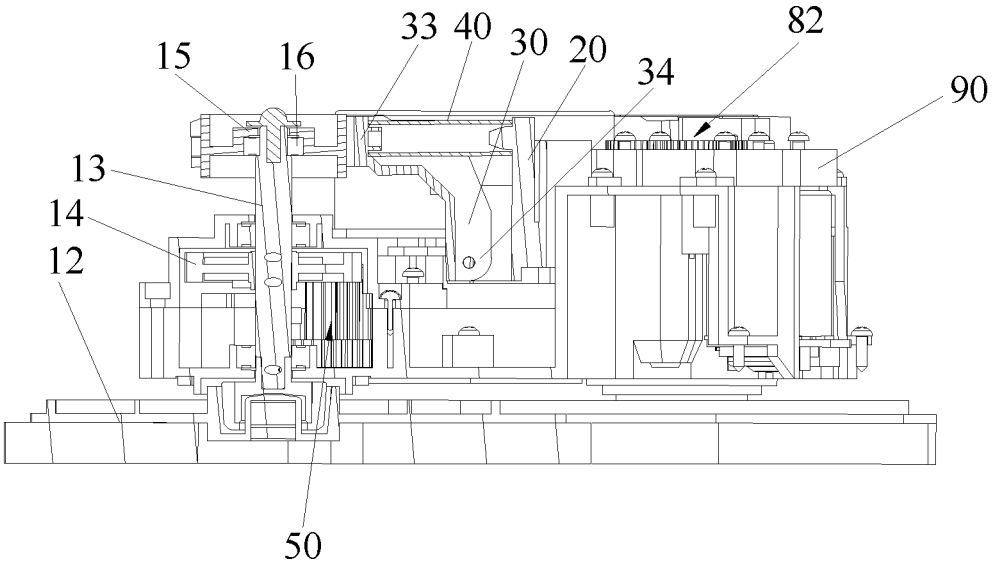
FIG. 5 is a cross-sectional view along line B-B of the cleaning assembly shown in FIG. 4 according to an embodiment.

Referring to FIGS. 1, 3 and 5, In some embodiments, the elastic force applying member may include a compression spring 40 connected between the mounting base 20 and the swing arm 30, and the compression spring 40 is compressed to store elastic potential energy when the swing arm 30 swings upward (it mainly refers to that part connected with the swinging arm 30 and the cleaning device 10, which may swing upward when the cleaning device 10 is pushed upward). When the pushing force disappears, the swinging arm 30 and the cleaning device 10 may reset due to the release of the elastic potential energy.

Specifically, the swing arm 30 includes a connecting arm 33 and a pivoting arm 34, a first end of the connecting arm 33 is cooperated with the positioning part 11, an upper end of the pivoting arm 34 is connected to a second end of the connecting arm 33, a lower end of the pivoting arm 34 is pivoted to the mounting base 20; and the compression spring 40 is connected between the second end of the connecting arm 33 and the mounting base 20. Of course, the swing arm 30 is not limited to the present particular form, and the compression spring 40 is not limited to the present arrangement.

In this embodiment, the cleaning assembly further includes a lifting drive assembly for driving the mounting base 20 to move up and down, and the swing arm 30 may move up and down with the movement of the mounting base 20, accordingly the cleaning device 10 may move and down as well. In such a way, the cleaning device 10 may be lifted up and kept in the lift position. Due to the lifting of the cleaning device 10, the cleaning robot may not be obstructed or affected by the cleaning device 10 when the cleaning robot moves but makes no cleaning action, thereby improving the adaptability of the cleaning robot.

Referring to FIG. 1, specifically, the swing arm 30 is provided with an abutting portion 35, and the mounting base 20 is provided with a blocking portion 21 for blocking the abutting portion 35 to limit the downward swing of the swing arm 30. Due to the engagement between the blocking portion 21 and the abutting portion 35, the swing arm 30 may move upward with an upward movement of the mounting base 20; and since the blocking portion 21 is kept in contact with the abutting portion 35 due to the elastic potential energy of the elastic force applying member, the swing arm 30 may move downward with a downward movement of the mounting base 20. In such a way, the swing arm 30 may be driven to stably move up and down, without any swings, as the mounting base 20 moves up and down.

In a specific example, the elastic potential energy of the horizontally arranged compression spring 40 may promote the blocking portion 21 and the abutting portion 35 to maintain firm contact, so that the swing arm 30 may move downward with the mounting base 20, meanwhile the swing of the swing arm 30 is prevented.

In this embodiment, the limiting structure provided to limit the downward swing of the swing arm 30 is not limited to the above manner in which the blocking portion 21 and the abutting portion 35 engage one another.

Please refer to FIG. 1, in this embodiment, two cleaning devices 10 are configured. A swing arm 30 is connected between each cleaning device 10 and the mounting base 20, respectively, so that the two cleaning devices 10 share one said mounting base 20. When the cleaning devices 10 need to be lifted, only one set of lifting drive assembly is required to drive the mounting base 20, which may effectively reduce the space occupation.

Figure 6:
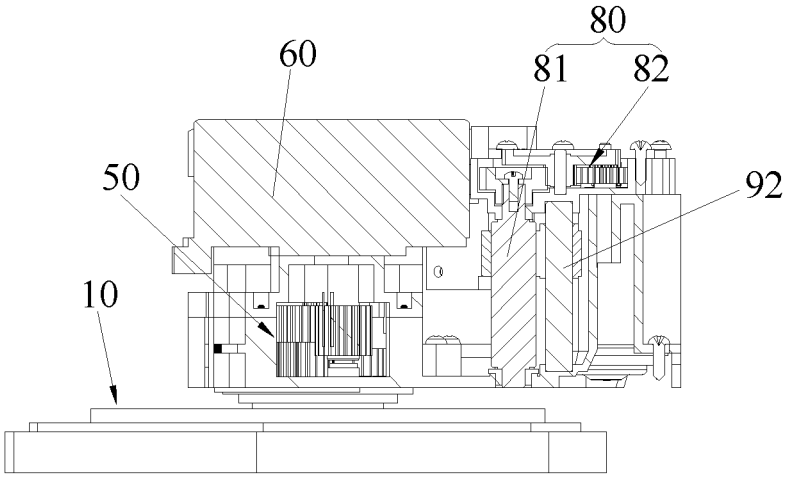
FIG. 6 is a cross-sectional view along line C-C of the cleaning assembly shown in FIG. 4 according to an embodiment.

Referring to FIGS. 1, 5 and 6, in this embodiment, the cleaning device 10 may include a cleaning module 12 for cleaning a surface and a rotating shaft 13 for rotating the cleaning module 12. Specifically, the cleaning module 12 is installed on the rotating shaft 13, and the rotating shaft 13 is connected with a rotation transmission mechanism 50 that is connected with a rotation drive motor 60. More specifically, the rotating shaft 13 is fixed in a circumferential direction and movable in an axial direction. As shown, the rotating shaft 13 is fixedly connected to a sliding base 15 and is rotatable relative to the sliding base 15, and the positioning part 11 is formed on the sliding base 15. In such a way, the cleaning device 10 not only may realize the rotary cleaning to the surface, but also may realize lifting and self-adaptive floating by the axial movement of the rotating shaft 13. In a specific example, the cleaning module 12 is a mopping module, which is not limited here however; and the sliding base 15 may be served as an end cover, and a bearing 16 is arranged between the sliding base 15 and the rotating shaft 13.

Regarding to the definition "the rotating shaft is movable in the axial direction", it may be realized through a key joint between the rotating shaft and the rotation transmission mechanism, or other connection manners, for example as shown in FIG. 5, the rotating shaft 13 is integrally formed with a gear part 14, which may make an axial movement relative to the transmission mechanism 50.

It should be noted that the lifting and self-adaptive floating of the cleaning device here are not necessarily realized by the axial movement of the rotating shaft, for example, it may also be realized by the overall lifting and floating of the rotation drive motor, the rotation transmission mechanism and the cleaning device. Of course, the cleaning device is not limited to this form and may not have a rotating function, for example. In addition, it should be noted that, "the rotating shaft is fixedly connected to the sliding base" means that there is no relative movement between each other, which may not affect the rotation of the rotating shaft however. The fixed connection manner may include connecting the both through a locking member, which is not limited here.

Referring to FIG. 1, in the present embodiment, the cleaning assembly further includes a fixing base 90 on which the lifting drive assembly is installed. As shown, the fixing base 90 is formed with a recess 91, and the mounting base 20 is arranged correspondingly to the recess 91. In such a way, the space occupation may be further reduced in the direction of height.

Referring to FIGS. 1 and 6, specifically, the lifting drive assembly includes a lifting drive motor 70 and a lifting transmission mechanism 80, the lifting transmission mechanism 80 includes a screw rod 81 and a gear set 82 respectively connected to the lifting drive motor 70 and the screw rod 81, and the screw rod 81 is in a thread connection with the mounting base 20 so as to lift the mounting base 20. The lifting drive motor 70 is installed in the fixing base 90, and the lifting drive motor 70 has an output shaft extended upward from the fixing base 90 to connect with the gear set 82, the gear set 82 is mounted on the fixing base 90 through a gear box 83, and the gear box 83 is partially suspended directly above the recess 91 so that the gear set 82 is connected with the screw rod 81. Such an arrangement brings a reasonable utilization of space. The lifting drive assembly is not limited to the above manner however.

Specifically, the fixing base 90 is provided with a guide rod 92, and the mounting base 20 is vertically slidably arranged on the guide rod 92. Under the guide of the guide rod 92, the lifting operation of the mounting base 20 is reliable.

In some embodiments, as shown in FIGS. 1, 5 and 6, the rotating shafts 13 of the two cleaning devices 40 are located at the same side of the mounting base 20, the two swing arms 30 are biased relative to the mounting base 20 to respectively connect with the corresponding rotating shaft 13. Further, the fixing base 90 is formed with a gear box 95, the gear box 95 and the rotating shafts 13 are located at the same side of the mounting base 20 and located directly above the two cleaning modules 12. Further, a rotation drive motor 60 is formed on the gear box 95, and the gear box 95 is provided with a gear set as the rotation transmission mechanism 50 for driving the rotation drive motor 60 and the rotating shafts 13. As a result, reasonable utilization of space is achieved.

FIGS. 7-13 show a cleaning assembly according to the second embodiment of the disclosure. In this embodiment, the overall configuration of the cleaning assembly and the configuration of its main components are different from those of the first embodiment.

Figure 7:
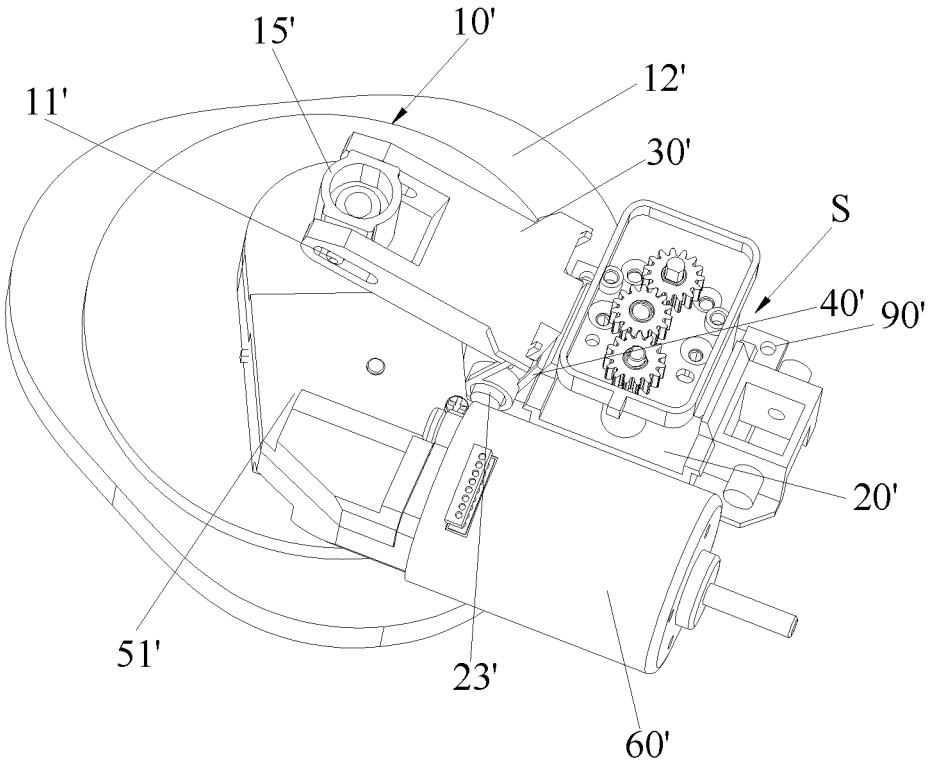
FIG. 7 is a perspective view of a cleaning assembly according to an embodiment of the present disclosure.
Figure 8:
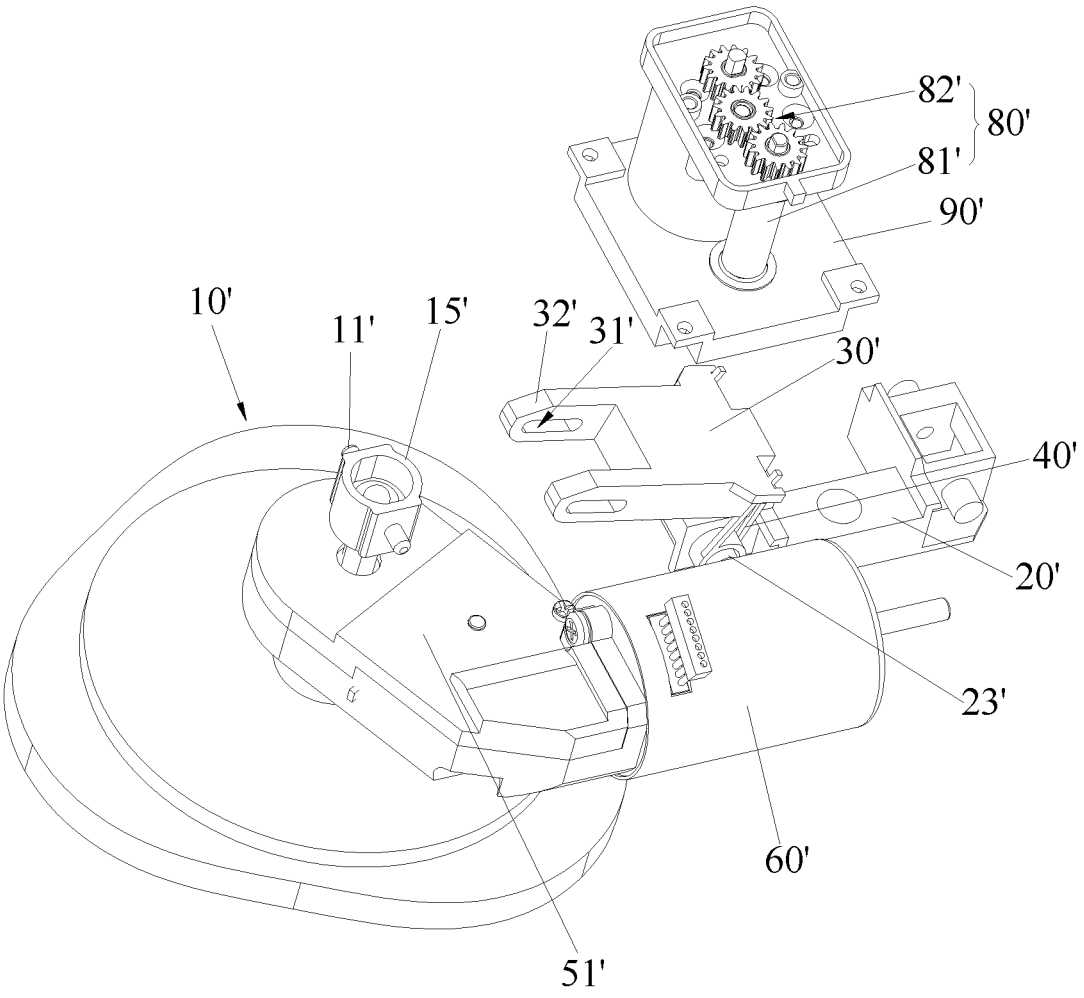
FIG. 8 is an exploded view of a cleaning assembly according to an embodiment of the present disclosure.
Figure 9:
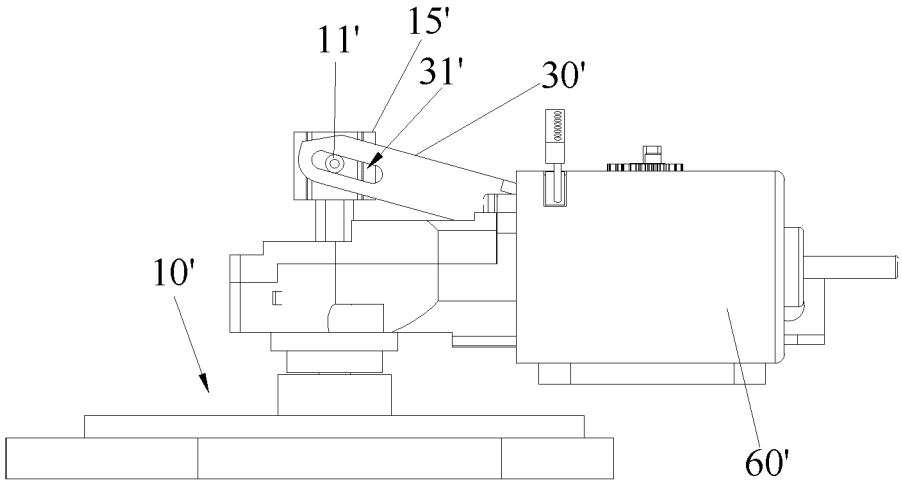
FIG. 9 is a side view of a cleaning assembly according to an embodiment of the present disclosure.
Figure 10:
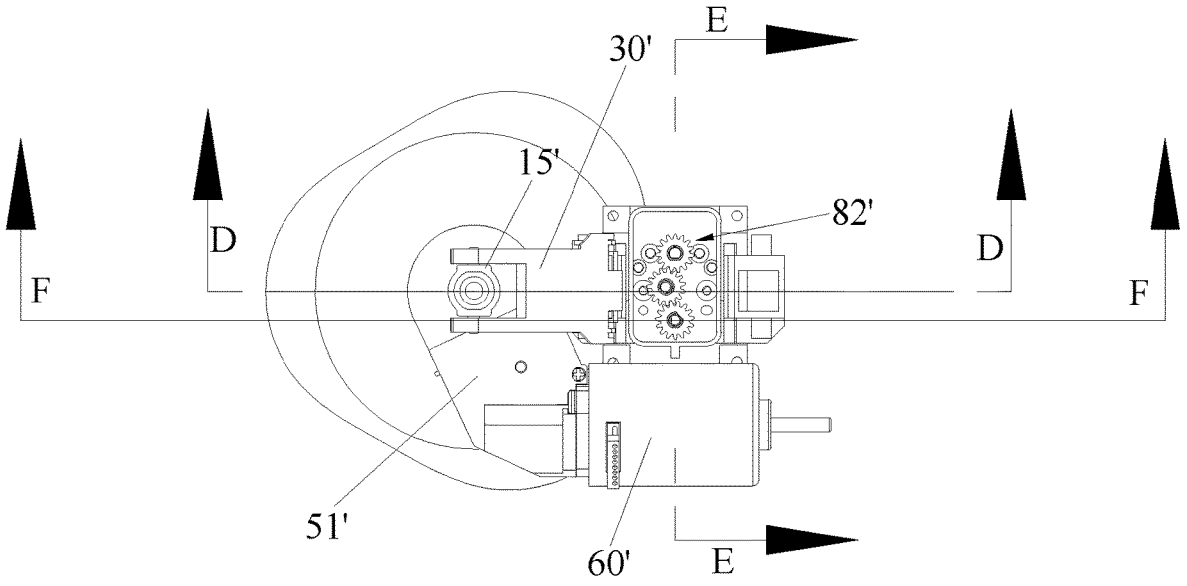
FIG. 10 is a top view of a cleaning assembly according to an embodiment of the present disclosure.

Referring to FIGS. 7 and 8. In this embodiment, the positioning portion 11' and the swing arm 30' are connected in substantially the same manner as the first embodiment, and the swing arm 30' is also provided with a sliding groove 31' that is engaged with the positioning portion 11'. In order to achieve a more reliable engagement between the swing arm 30' and the cleaning device 10', the swing arm 30' also includes two arms 32' arranged oppositely, and the both arms 32' are provided with a sliding groove 31' respectively, and the cleaning device 10' is provided with two said positioning parts 11' symmetrically arranged. Based on such a configuration, the two positioning parts 11' are correspondingly slidably arranged in the two sliding grooves 31'.

Figure 13:
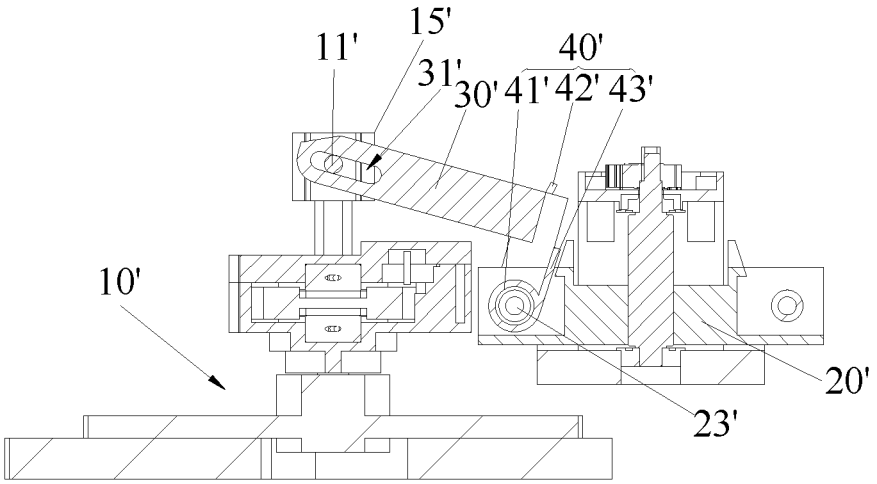
FIG. 13 is a cross-sectional view along line F-F of the cleaning assembly shown in FIG. 10 according to an embodiment.

Referring to FIGS. 7 and 13, in this embodiment, the elastic force applying member is in the form of a torsion spring. Specifically, the torsion spring 40' has a torsion spring body 41', a first torsion arm 42' and a second torsion arm 43' connected to both sides of the torsion spring body 41'; the torsion spring body 41' is mounted on the mounting base 20', the first torsion arm 42' is abutted against the swing arm 30', the second torsion arm 43' is abutted against the mounting base 20'. In such an arrangement, the first torsion arm 42' may be pushed by the swing arm 30' when the swing arm 30' swings upward to generate the elastic potential energy for the torsion spring body 41', and the swing arm 30' may easily make a backswing under a release of the elastic potential energy.

Figure 11:
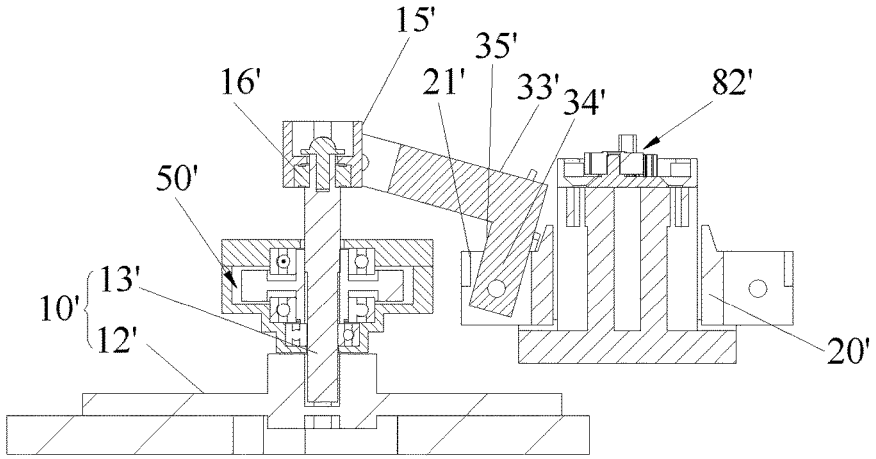
FIG. 11 is a cross-sectional view along line D-D of the cleaning assembly shown in FIG. 10 according to an embodiment.

Referring to FIGS. 11 and 13, specifically, the swing arm 30' includes a connecting arm 33' and a pivoting arm 34', a first end of the connecting arm 33' is cooperated with the positioning part 11', an upper end of the pivoting arm 34' is connected to a second end of the connecting arm 33', a lower end of the pivoting arm 34' is pivoted to the mounting base 20'. The mounting base 20' is provided with a torsion spring shaft 23' which has the same axis with a pivoting position of the pivoting arm 34', the torsion spring body 41' is sleeved on the torsion spring shaft 23', and the first torsion arm 42' is abutted against the second end of the connecting arm 33'.

Referring to FIG. 11, in this embodiment, the swing arm 30' is provided with an abutting portion 35', and the mounting base 20' is provided with a blocking portion 21' for blocking the abutting portion 35' to limit the downward swing of the swing arm 30'. Due to the engagement between the blocking portion 21' and the abutting portion 35', the swing arm 30' may move upward with an upward movement of the mounting base 20'. Of course, the limiting structure provided to limit the downward swing of the swing arm 30' is not limited to the above manner in which the blocking portion 21' and the abutting portion 35' engage one another.

In this embodiment, the cleaning assembly also includes a lifting drive assembly for driving the mounting base 20' to move up and down. in a specific example, when the mounting base 20' is driven to move downward, the blocking portion 21' is kept in contact with the abutting portion 35' due to the elastic potential energy of the torsion spring 40', so that the swing arm 30' moves downward with the mounting base 20'.

Please refer to FIG. 7, two cleaning devices 10' are configured in this embodiment. A swing arm 30' is connected between each cleaning device 10' and the mounting base 20', respectively, so that the two cleaning devices 10' share one said mounting base 20'. When the cleaning devices 10' need to be lifted, only one set of lifting drive assembly is required to drive the mounting base 20', which may effectively reduce the space occupation.

Referring to FIGS. 7 and 11, in this embodiment, the cleaning device 10' may include a cleaning module 12' for cleaning a surface and a rotating shaft 13' for rotating the cleaning module 12'. Specifically, the rotating shaft 13' is connected with a rotation transmission mechanism 50' that is connected with a rotation drive motor 60'. More specifically, the rotating shaft 13' is fixed in a circumferential direction and movable in an axial direction. As shown, the rotating shaft 13' is fixedly connected to a sliding base 15' and is rotatable relative to the sliding base 15', and the positioning part 11' is formed on the sliding base 15'. In such a way, the cleaning devices 10' not only may realize the rotary cleaning to the surface, but also may realize lifting and self-adaptive floating by the axial movement of the rotating shaft 13'. In a specific example, the cleaning module 12' is a mopping module, which is not limited here however;

and the sliding base 15' may be served as an end cover, and a bearing 16' is arranged between the sliding base 15' and the rotating shaft 13'.

Figure 12:
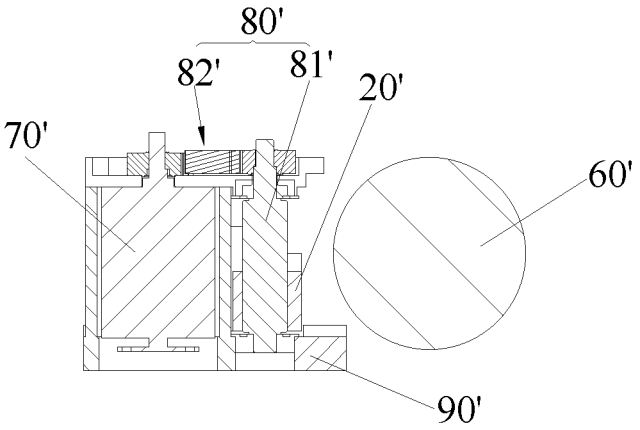
FIG. 12 is a cross-sectional view along line E-E of the cleaning assembly shown in FIG. 10 according to an embodiment.

As shown in FIGS. 1, 11, and 12, the rotating shafts 13' of the two cleaning devices 10' are located at the same side of t rotation drive motor 60', two rotation transmission mechanisms 50' are connected to the respective rotating shaft 13' and respectively installed in two rotation transmission boxes 51', and an accommodating space S for receiving the lifting assembly and the mounting base 20' is formed between the two rotation transmission boxes 51'. Specifically, the lifting drive assembly mounted on a fixing base 90' includes a lifting drive motor 70' and a lifting transmission mechanism 80', the lifting transmission mechanism 80' includes a screw rod 81' and a gear set 82', and the screw rod 81' is in a thread connection with the mounting base 20' so as to lift the mounting base 20'. In such an arrangement, the utilization of space becomes reasonable.

FIGS. 14-17 show a third embodiment and a fourth embodiment according to the present disclosure. A cleaning robot is provided, which includes a main body (not shown) and a cleaning assembly arranged on the main body.

The cleaning assembly includes a rotating mechanism a and a cleaning device d/d'. The rotating mechanism a includes a rotation drive motor b0 and a rotation transmission mechanism a0/a0' connected with the rotation drive motor b0. The cleaning device d/d' includes a rotating shaft d0/d0' and a cleaning module f0/f0', the rotating shaft d0/d0' is provided with a gear part e0/e0' (i.e., a first gear e0/e0'), and the cleaning module f0/f0' is connected to the lower end of the rotating shaft d0/d0' and configured at the bottom side of the main body. The rotation transmission mechanism a0/a0' and the gear part e0/e0' are connected in transmission to rotate the rotating shaft d0/d0'.

The cleaning device d/d' may be lifted or lowered in the axial direction of the rotating shaft d0/d0'. When the cleaning device d/d' is lifted or lowered, the gear part e0/e0' moves axially relative to the rotation transmission mechanism a0/a0'. In the following specific embodiments, the cleaning module f0/f0' is a mopping module, which is not limited however. For example, the cleaning module may also be a side brush module. The rotation transmission mechanism may use the rotation transmission mechanism 50/50' in the first and the second embodiments, which is not limited however. In some embodiment, the lowering of the cleaning device is defined as moving of the cleaning device and/or the shaft in a first axial direction. The lifting of the cleaning device is defined as moving of the cleaning device and/or the shaft in a second axial direction.

The cleaning device d/d' of the present disclosure may be lifted or lowered in the axial direction of the rotating shaft d0/d0', so that the cleaning module f0/f0' may be lifted or lowered relative to the main body of the cleaning robot, thereby improving the adaptability of the cleaning robot. In addition, in the cleaning assembly of the present disclosure, the gear part e0/e0' on the rotating shaft d0/d0' is driven by the rotation transmission mechanism a0/a0', so that the rotating shaft d0/d0' and the cleaning device d/d' are rotated together. Compared with the way in which the gear directly drives the rotating shaft to rotate and the rotating shaft moves axially relative to the gear, there is no need for the rotating shaft d0/d0' in the present disclosure to have a high-precision polygonal cross section, which is convenient for processing and reducing processing costs.

The specific implementation manner of "the cleaning device may be lifted and lowered in the axial direction of the rotating shaft" is not limited in the present disclosure. For example, the cleaning device is lifted upward and returned downward under an action of a lifting mechanism, or the cleaning device makes a self-adaptive floating while cleaning the ground. Further, a manual lifting for the cleaning device is not excluded, or the cleaning device may simultaneously have lifting function (via a lifting mechanism) and self-adaptive floating function.

Specifically, the rotation transmission mechanism a0/a0' includes a transmission gear a01/a01' (i.e., a second gear a01/a01'). The gear part e0/e0' is coaxially arranged on the rotating shaft d0/d0', and the gear part e0/e0' is fixedly connected to the rotating shaft d0/d0' or formed with the rotating shaft d0/d0' in an integrated structure. The transmission gear a01/a01' is configured to mesh with the gear part e0/e0' to drive the cleaning device d/d' to rotate. When the cleaning device d/d' is lifted or lowered, the gear part e0/e0' moves axially relative to the transmission gear a01/a01'. By this token, the gear part e0/e0' is fixedly connected to the rotating shaft d0/d0' or formed with the rotating shaft d0/d0' in an integrated structure (the same part), therefore it is ensured that the gear part e0/e0' together with the rotating shaft d0/d0' may move axially relative to the transmission gear a01/a01' while the cleaning device d/d' is lifting or lowered. In some embodiment, the transmission gear a0/a0' has an axial dimension between 2 mm and 50 mm.

It may be understood that the rotating mechanism is not limited to the above-mentioned form, and any form to drive the gear part of the cleaning device may be suitable.

Figure 14:
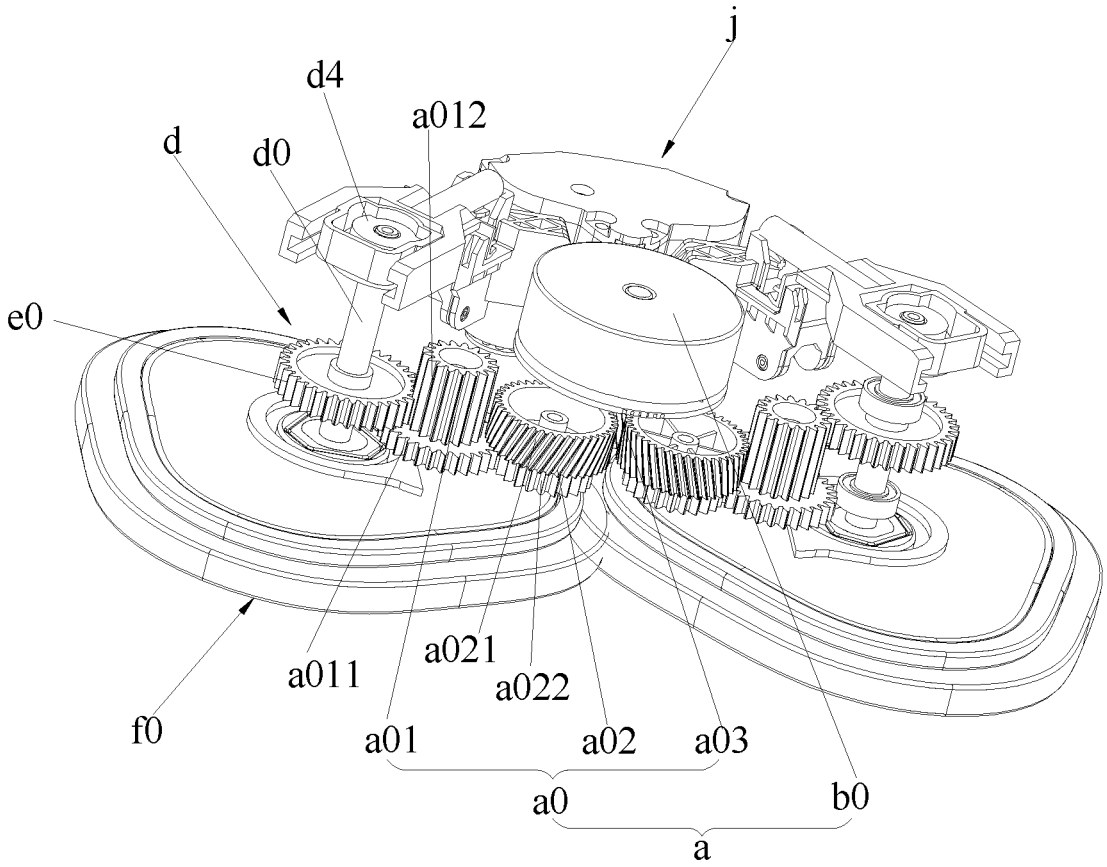
FIG. 14 is a perspective view of a cleaning assembly according to an embodiment of the present disclosure.
Figure 15:
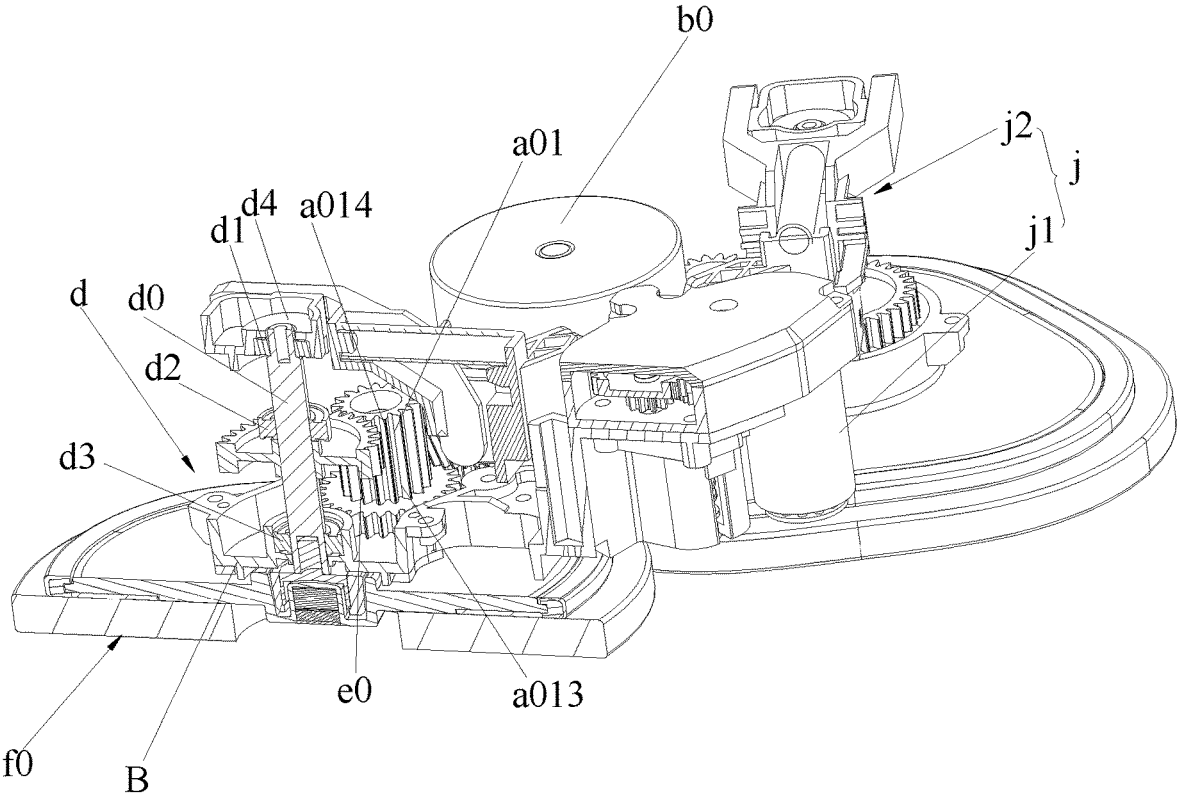
FIG. 15 is a cross-sectional view of a cleaning assembly according to an embodiment of the present disclosure.

The third embodiment of the present disclosure may be further described below in conjunction with FIG. 14 and FIG. 15.

In this embodiment, the rotation transmission mechanism a0 includes at least one intermediate gear a02 for transmitting the movement of the rotation drive motor b0 to the transmission gear a01.

Specifically, the transmission gear a01 includes a first gear part a011 and a second gear part a012 that are coaxially connected, the first gear part a011 is configured to mesh with the intermediate gear a02, and the second gear part a012 is configured to mesh with the gear part e0. Optionally, it is not excluded that the first gear part a011 and the second gear part a012 are independent parts but fixed as a whole.

Further, in this embodiment, two cleaning devices d are configured and driven by a common rotary drive motor b0. The output end of the rotary drive motor b0 is connected to a driving gear a03 for transmission, and the driving gear a03 is configured to mesh with two intermediate gears a02. Specifically, the intermediate gear a02 includes a third gear part a021 and a fourth gear part a022 that are coaxially connected. The third gear part a021 is configured to mesh with the driving gear a03, and the fourth gear part a022 is configured to mesh with the first gear part a011 of the transmission gear a01.

It may be understood that the rotating mechanism is not limited to the above-mentioned form, and any form to drive the gear part of the cleaning device may be suitable.

In this embodiment, the transmission gear a01 and the gear part e0 are spur gears. The rotation of the transmission gear a01 is transmitted to the gear part e0 and converted into the rotation of the gear part e0.

In order to lift up the cleaning module f0, the cleaning assembly further includes a lifting mechanism j, which is connected to the cleaning device d and configured to lift the cleaning device d, so that the lifting mechanism j is controllable as needed, for example to lift off the ground when ground cleaning is not required. For example, when there is a need to return for repeating the cleaning, the lifting mechanism j is controlled to be lifted thereby avoiding secondary pollution to the cleaned ground.

When the lifting mechanism j lifts the cleaning device d, the gear part e0 together with the rotating shaft d0 are configured to move upward relative to the transmission gear a01.

Specifically, the lifting mechanism j includes a lifting drive motor j1 and a lifting transmission mechanism j2. The lifting transmission mechanism j2 is connected to the output end of the lifting drive motor j1 and configured to transmit movements to the rotating shaft d0. Specifically, under the driving of the lifting drive motor j1 and the movements of the lifting transmission mechanism j2, the rotating shaft d0 may be lifted upward, so that the entire cleaning device d including the gear part e0 may be lifted upward accordingly. When the cleaning device d needs to return downward, the lifting drive motor j1 is driven in the reverse direction, and the rotating shaft d0 is lowered down due to the movement of the lifting transmission mechanism j2.

Further, the upper end of the rotating shaft d0 is provided with a rotating separation base d4 which is configured to move synchronously in the axial direction with the rotating shaft d0. The output end of the lifting transmission mechanism j2 is configured to act on the rotating separation base d4, and the rotating shaft d0 is lifted accordingly when the rotating separation base d4 is lifted.

In this embodiment, the form of the rotating separation base d4 is not limited, and it may be an individual part or a combination of more than one parts; any form to achieve the rotating separation with the rotating shaft d0 and to drive the rotating shaft d0 may be suitable.

Specifically, a support bearing d1 may be provided between the rotating separation base d4 and the rotating shaft d0. Further, the inner ring of the support bearing d1 may be fixed to the rotating shaft d0 through a screw for example.

Optionally, it is not excluded that the rotating separation base d4 is a bearing or includes a bearing. For example, the rotating separation base d4 may include an outer ring of the support bearing d1.

It may be understood that the lifting mechanism j may be various forms capable of lifting the cleaning device d, for example, the lifting drive assembly in the embodiment shown in FIGS. 1 to 13 may be utilized as lifting mechanism. As for the downward return of the cleaning device d, it's unnecessary to have to rely on the transmission of the lifting transmission mechanism j2. For example, in different embodiments, when the lifting drive motor j1 is driven, the output end of the lifting drive mechanism j2 may lift up the cleaning device d; when it's require to lower the cleaning device d, the lifting drive motor j1 is driven in the reverse direction, and the lifting transmission mechanism j2 moves in the reverse direction so that its output end moves downward to retract support from the cleaning device d, as a result the cleaning device d returns downward.

Specifically, in this embodiment, the transmission gear a01 includes a first meshing area a013 located at a lower part thereof and a second meshing area a014 located above the first meshing area a013. When the cleaning device d cleans the ground, the gear part e0 meshes with the first meshing area a013 to drive the cleaning module f0 to rotate; when the cleaning device d is in the lifting state, the gear part e0 moves upward and meshes with the second meshing area a014. That is to say, when the cleaning device d is converted from the normal cleaning position of contacting with the ground to the lifting state disengaged from the ground, the meshing between the gear part e0 with the transmission gear a01 is maintained, so that the gear part e0 may be directly moved along the meshing area of the transmission gear a01 when the cleaning device d returns downward, thereby avoiding a misalignment of the gear part e0 with the transmission gear a01 when the gear part e0 returns downward, and ensuring the reliability accordingly.

The gear part e0 is driven to rotate by the transmission gear a01 mainly based on the meshing between the first meshing area a013 and the gear part e0, while the second meshing area a14 is rarely meshed with the gear part e0, and may mesh with the gear part e0 only during the lifting process and in the lifting state. By this token, the first meshing area a013 of the transmission gear a01 may receive more friction than the second meshing area a014. If the strength of the transmission gear a01 is insufficient, more abrasion may occur on the first meshing area a013 of the transmission gear a01 due to the long-term friction, which brings jamming during the movement of the gear part e0 along the transmission gear a01. In view of this, in this embodiment, the strength of the transmission gear a01 is greater than that of the gear part e0, so that the abrasion difference between the first meshing area a013 and the second meshing area a014 of the transmission gear a01 is reduced.

Figure 16:
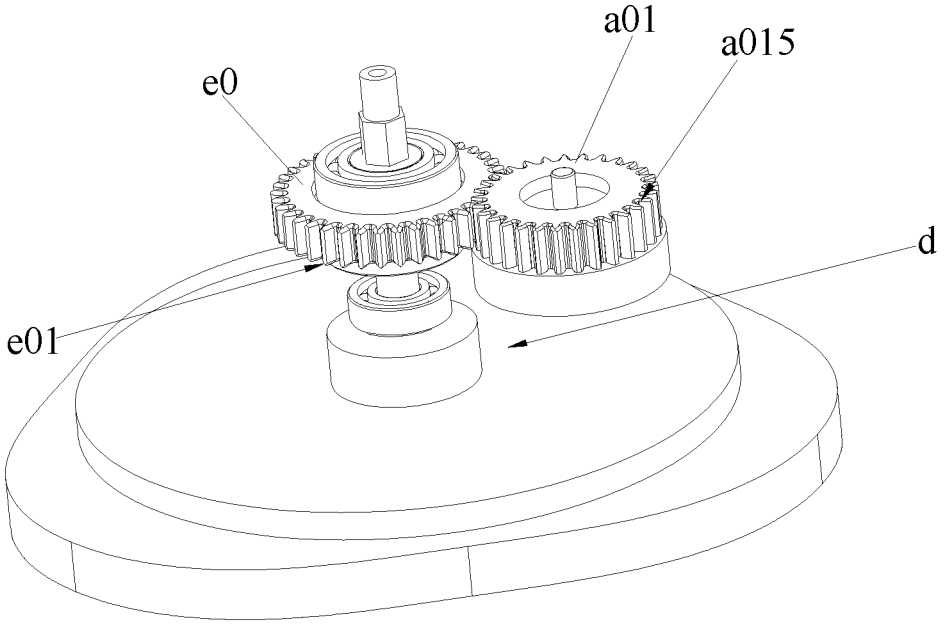
FIG. 16 is another perspective view of a cleaning assembly according to an embodiment of the present disclosure.

Optionally, when the cleaning device d is lifted, the gear part e0 moves upward relative to the transmission gear a01, which is unnecessary to have to maintain the meshing with the transmission gear a01. For example, while the cleaning device d cleans the ground, the gear part e0 meshes with the transmission gear a01 to drive the cleaning module f0 to rotate; while the cleaning device d is in the lifting state, the gear part e0 moves upward to separate from the transmission gear a01, as shown in FIG. 16.

In this case, it's necessary for the gear part e0 to re-mesh with the transmission gear a01 while the cleaning device d returns downward. In some embodiments, for ensuring a smooth meshing between the gear part e0 and the transmission gear a01, a guide groove a015 is connected to the upper end of the tooth groove of the transmission gear a01, which is configured to guide the teeth of the gear part e0 to the tooth groove of the transmission gear a01 while the cleaning device d returns downward. Specifically, a respective guide groove a015 is provided at the upper end of each tooth groove of the transmission gear a01, or provided at the upper end of partial tooth groove of the transmission gear a01. Optionally, a guide groove e01 may also be connected to the lower end of the tooth groove of the gear part e0, which is configured to guide the teeth of the transmission gear a01 to the tooth groove of the gear part e0 while the cleaning device d returns downward. Specifically, a respective guide groove e01 is provided at the lower end of each tooth groove of the gear part e0, or provided at the lower end of partial tooth groove of the gear part e0. Alternatively, both the upper end of the tooth groove of the transmission gear a01 and the lower end of the tooth groove of the gear part e0 are provided with a respective guide groove e01. Specifically, both the upper end of each tooth groove of the transmission gear a01 and the lower end of each tooth groove of the gear part e0 are provided with a respective guide groove a015/e01, alternatively, only the upper end of partial tooth groove of the transmission gear a01 and the lower end of partial tooth groove of the gear part e0 are provided with a respective guide groove a015/e01.

It may be understood that the forms and matching manners of the transmission gear and the gear part are not limited to the above-mentioned specific embodiments, and any forms to implement the gear part moving axially relative to the transmission gear may be suitable.

In order to limit the lifting range and return range of the cleaning device d, the cleaning assembly may include an upper limiting structure (i.e., a first limiting structure) and a lower limiting structure (i.e., a second limiting structure). Specifically, the upper limiting structure is configured to stop the upward movement of the gear part e0 to limit the upward movement range of the gear part e0, and the lower limiting structure is configured to stop the downward movement of the gear part e0 to limit the downward movement range of the gear part e0. In such a way, the reliability of the movement of the cleaning device d is ensured.

Specifically, a first bearing d2 and a second bearing d3 spaced up and down are sleeved on the rotating shaft d0, which are served as the upper limiting structure d2 and the lower limiting structure d3, respectively. That is, the gear part e0 is restricted to move up and down between the first bearing d2 and the second bearing d3. The first bearing d2 and the second bearing d3 may be installed in a transmission box B (not fully shown) of the rotating mechanism a.

Optionally, the forms of the upper limiting structure and the lower limiting structure are not limited to bearings. For example, other structures formed on the transmission box for stopping the gear part e0 may be acceptable.

Figure 17:
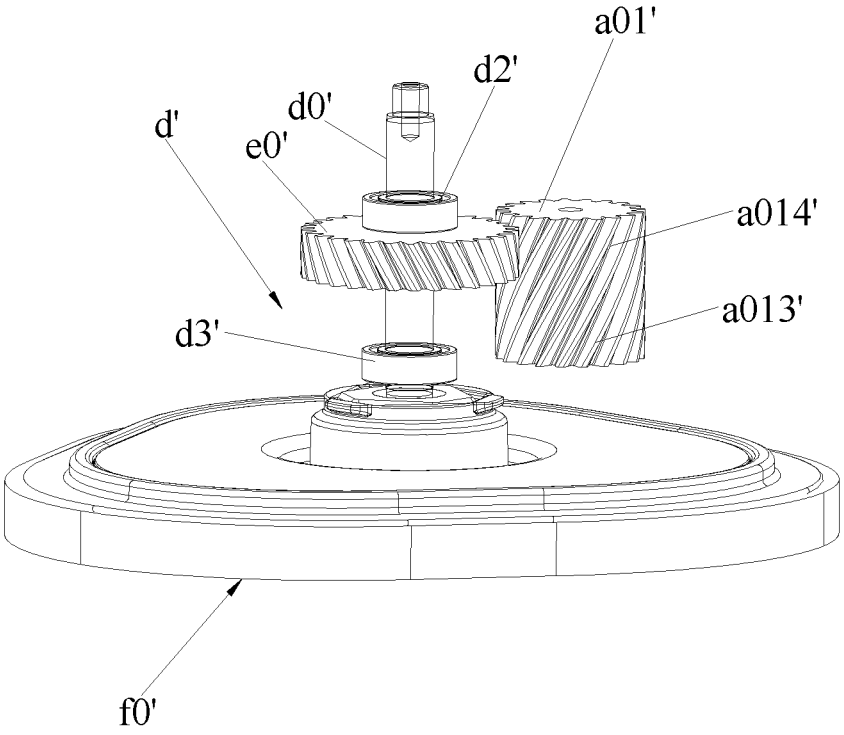
FIG. 17 is a perspective view of a cleaning assembly according to an embodiment of the present disclosure.

The fourth embodiment of the present disclosure may be further described below in conjunction with FIG. 17.

In this embodiment, the transmission gear a01' and the gear part e0' are helical gears.

In this way, the cleaning device d' is driven to rotate relative to the ground due to the transmission of the transmission gear a01' and the gear part e0', furthermore, the gear part e0' is driven to rotate and meanwhile move axially upward by the transmission gear a01'.

With the above arrangement, it's only require to configure a rotating mechanism with such a transmission gear a01' to realize rotation cleaning and lifting for the cleaning device d', no special lifting mechanism is required, which is beneficial to the structure simplification and the cost reduction.

Specifically, the transmission gear a01' has a first rotation direction in which the gear part e0' may move downward and a second rotation direction in which the gear part e0' may move upward. When the transmission gear a01' rotates in the second rotation direction, the gear part e0' is moved upward along the transmission gear a01' to lift the cleaning device d' due to the meshing between the transmission gear a01' and the gear part e0', and the gear part e0' is rotated to adjust a lifting angle of the cleaning module d' in the lifted state. When the transmission gear a01' stops rotating, the transmission gear a01' keeps meshing with the gear part e0' to maintain the cleaning device d' in the lifting state. In such a way, the angle of the cleaning module f0' is adjustable during the lifting process of the cleaning module f0' to facilitate the cleaning module f0' to be at a proper lifting angle.

Optionally, a special lifting mechanism may be utilized to lift the cleaning device d'. In this case, the transmission gear a01' may always rotate in a fixed direction, which is not limited however. When there is a need to lift up the cleaning device d', the rotation drive motor stops driving to lock the transmission gear a01', and then the lifting mechanism is operated to lift up the cleaning device d'. When there is a need to return downward from the lifting state, the rotation transmission of the transmission gear a01' and/or the driving of the lifting mechanism may be utilized, which is not limited here.

Specifically, during the lifting process of the cleaning device d', the transmission gear a01' is in a locked state, the gear part e0' keeps meshing with the transmission gear a01', therefore the gear part e0' is rotatable under the push action of the transmission gear a01', so that the lifting angle of the cleaning module f0' in the lifting state is adjustable. In such a way, the angle of the cleaning module f0' is adjustable during the lifting process of the cleaning module f0' to facilitate the cleaning module f0' to be at a proper lifting angle.

In some embodiments, the cleaning assembly includes two cleaning devices d', d arranged side by side. The gear part e0 of one of the two cleaning devices d', d and the corresponding transmission gear a01 are spur gears, and the gear part e0' of the other of the two cleaning devices d', d and the corresponding transmission gear a01' are helical gears. Further, the cleaning assembly includes a lifting mechanism connected with the cleaning devices d', d and configured to lift the cleaning devices d', d. During the lifting process of the cleaning devices d', d, the respective transmission gear a0'/a01 is in a locked state, the gear part e0' (helical gear) is rotatable under the push action of the transmission gear a01', so that the lifting angle of the cleaning module f0' corresponding to the gear part e0' in the lifting state is adjustable. In such a way, the angle of the cleaning module f0' or f0 is adjustable while lifting the cleaning module f0', f0, thereby facilitating the cleaning module f0' to be at a proper lifting angle.

In this embodiment, the cleaning assembly further includes a lower limiting structure configured to limit the downward movement range of the gear part e0' along the transmission gear a01'.

Under a situation of that the gear part e0' is moved downward due to the transmission of the transmission gear a01', the gear part e0' may be stopped by the lower limiting structure and may not further move downward, but the transmission gear a01' may keep rotating to transmit its rotation into the rotation of the gear part e0', such that the entire cleaning device d' may be reliably driven by the gear part e0' to clean the ground.

Optionally, in other embodiments, the transmission gear a01' may be locked, and the gear part e0' may be driven to move downward by a lifting mechanism and may be restricted once reaching to the lower limit structure.

Specifically, a second bearing d3' is sleeved on the rotating shaft d0', which is served as the lower limiting structure. That is, the gear part e0' is restricted and stopped by the second bearing d3' while moving downward. The second bearing d3' may be installed in a transmission box (not shown) of the rotating mechanism. Optionally, the lower limiting structure is not limited to the second bearing d3'. For example, other structures formed on the transmission box for stopping the gear part e0' may be acceptable.

Specifically, the cleaning assembly may further include an upper limiting structure to limit the upward movement range of the gear part e0' along the transmission gear a01', so as to ensure the reliability of the movement of the cleaning device d'.

Furthermore, a first bearing d2' is sleeved on the rotating shaft d0', which is served as the upper limiting structure. That is, the gear part e0' is restricted and stopped by the first bearing d2' while moving upward. The first bearing d2' may be installed in the transmission box (not shown) of the rotating mechanism. Optionally, the upper limiting structure is not limited to the first bearing d2'. For example, other structures formed on the transmission box for stopping the gear part e0' may be acceptable.

Specifically, in this embodiment, the transmission gear a01' includes a first meshing area a013' (i.e., a first gear section a013') located at the lower part thereof and a second meshing area a014' (i.e., a second gear section a014') located above the first meshing area a013'. The gear part e0' is configured to mesh with the first meshing area a013' to drive the cleaning module f0' to rotate while the cleaning device d' cleans the ground; and the gear part e0' is configured to move upward and mesh to the second meshing area a014' while the cleaning device d' is in the lifting state.

The gear part e0' is driven to rotate by the transmission gear a01 mainly based on the meshing between the first meshing area a013' and the gear part e0', while the second meshing area a14' is rarely meshed with the gear part e0', and may mesh with the gear part e0' only during the lifting process and in the lifting state. By this token, the first meshing area a013' of the transmission gear a01' may receive more friction than the second meshing area a014'. If the strength of the transmission gear a01' is insufficient, more abrasion may occur on the first meshing area a013' of the transmission gear a01' due to the long-term friction, which brings jamming during the movement of the gear part e0' along the transmission gear a01'. In view of this, in this embodiment, the strength of the transmission gear a01' is greater than that of the gear part e0', so that the abrasion difference between the first meshing area a013' and the second meshing area a014' of the transmission gear a01' is reduced.

It may be understood that the forms and matching manners of the transmission gear and the gear part are not limited to the above-mentioned specific embodiments, any forms to implement the gear part moving axially relative to the transmission gear is acceptable.

Figure 18:
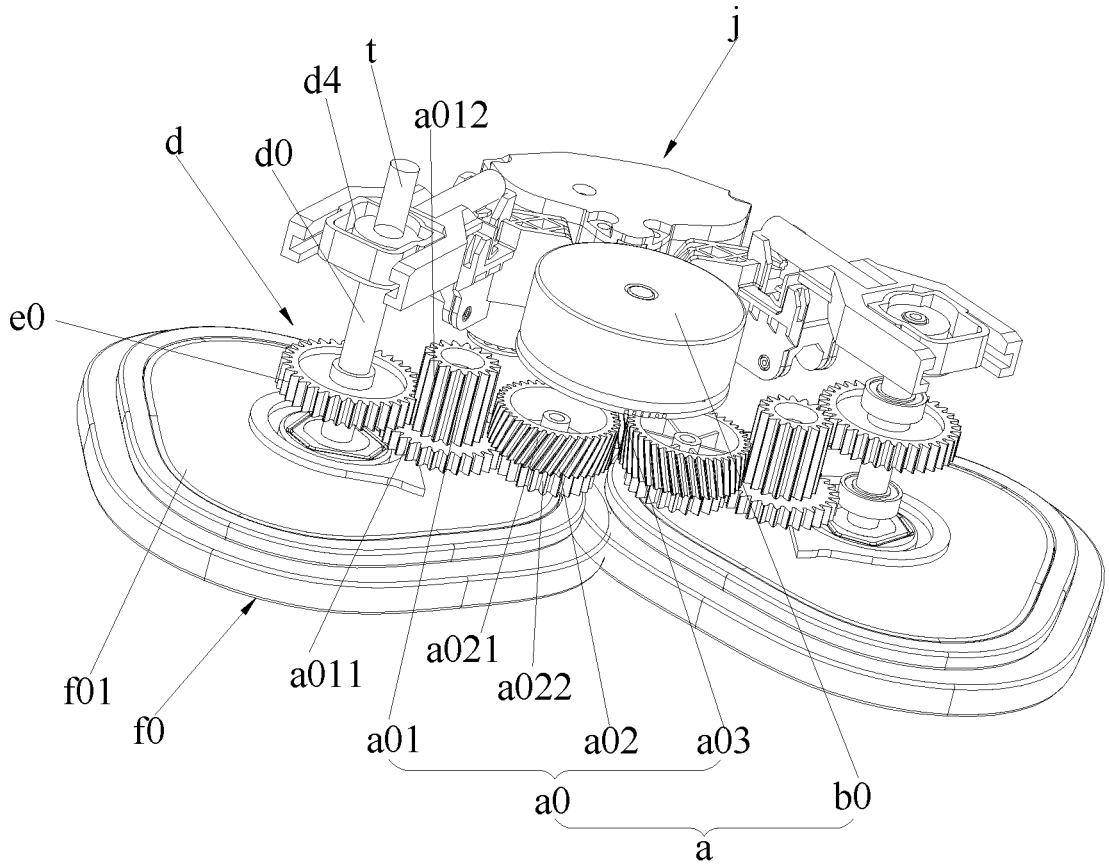
FIG. 18 is a perspective view of a cleaning assembly according to an embodiment of the present disclosure.

The fifth embodiment of the present disclosure may be described below in conjunction with FIG. 18.

The main differences between the present embodiment and the third embodiment follow: the cleaning assembly is provided with a force applying mechanism on the rotating separation base d4, and the force applying mechanism is configured to act on the rotating separation base d4. Specifically, the force applying mechanism is configured to increase elastic potential energy due to an upward movement of the rotating separation base d4 while the cleaning device d is lifted up, and further configured to release the elastic potential energy on the rotating separation base d4 to facilitate the cleaning device d to return downward. By arranging the force applying mechanism on the rotating separation base d4, the downward return of the cleaning device d is facilitated, and the arrangement of the force applying mechanism is simple. In some embodiments, when the cleaning device d cleans the horizontal ground, the force applying mechanism is configured to apply pressure on the rotating separation base d4 so as to increase the pressure of the cleaning module f0 on the ground.

In addition, the force applying mechanism is not limited to act on the rotating separation base d4. For example, the force applying mechanism may be arranged between the rotating shaft d0 and the cleaning module f0 and configured to apply a downward force to the cleaning module f0.

When the cleaning module f0 floats upward, the elastic potential energy of the force applying mechanism is increased to assist the cleaning module f0 to return downward. In some embodiments, when the cleaning module f0 cleans the horizontal ground, the force applying mechanism is configured to apply pressure to the cleaning module f0 so as to increase the pressure of the cleaning module f0 on the ground.

Specifically, the force applying mechanism may be an elastic force applying mechanism t, which is not limited however. According to different situations, the elastic force applying mechanism t may include a compression spring, a tension spring, an elastic cord or a torsion spring, and the like.

Optionally, more than one force applying mechanisms may be configured, and arranged in different positions, which may also achieve the corresponding function as above.

In addition, a counterweight is provided on the cleaning module f0, and/or the cleaning module f0 includes a turntable structure f01 at least partially composed of heavy metals, so as to increase the pressure of the cleaning module f0 on the ground. In this instance, the aforementioned force applying mechanism may be further utilized, or not configured, alternatively.

While the disclosure has been described in connection with what are presently considered to be the most practical and preferred embodiments, it is to be understood that the disclosure is not to be limited to the disclosed embodiments, but on the contrary, is intended to cover various modifications and equivalent arrangement included within the spirit and scope of the disclosure.

What is claimed is:

1. A cleaning assembly, comprising:

a motor;

a transmission mechanism coupled with the motor; and a cleaning device comprising:

a shaft having a first gear mounted thereon and coupled with the transmission mechanism, the shaft being configured to rotate in response to an output of the transmission mechanism and to move axially, and a cleaning module mounted to an end of the shaft and configured to clean a surface area; and a first limiting structure slidingly engaged with the shaft and configured to limit the axial movement of the shaft in a first axial direction through a first contact with the first gear.

2. The cleaning assembly according to claim 1, further comprising a second limiting structure slidingly engaged with the shaft and configured to limit the axial movement of the shaft in a second axial direction through a second contact with the first gear.

3. The cleaning assembly according to claim 2, wherein the first limiting structure and the second limiting structure are bearings.

4. The cleaning assembly according to claim 2, wherein the transmission mechanism is configured to generate one or more rotational outputs, and the shaft is configured to move in at least one of the first axial direction or the second axial direction in response to the one or more rotational outputs of the transmission mechanism.

5. The cleaning assembly according to claim 4, wherein the shaft is configured to rotate in a first rotational direction and move in the first axial direction in response to a first rotational output of the transmission mechanism.

6. The cleaning assembly according to claim 5, wherein:

the first axial direction is towards the surface area, the first gear is configured to contact the first limiting structure, and the shaft is configured to press the cleaning module against the surface area while continuing the rotation in the first rotational direction in response to the first rotational output of the transmission mechanism.

7. The cleaning assembly according to claim 4, wherein the shaft is configured to rotate in a second rotational direction and move in the second axial direction in response to a second rotational output of the transmission mechanism.

8. The cleaning assembly according to claim 7, wherein the first gear is configured to contact the second limiting structure, and the shaft is configured to stop moving in the second axial direction and separate the cleaning module from the surface area.

9. The cleaning assembly according to claim 8, wherein the shaft is configured to continue to rotate in the second rotational direction in response to the second rotational output of the transmission mechanism after stopping moving in the second axial direction.

10. The cleaning assembly according to claim 2, wherein the first and second limiting structures are disposed in a housing of the transmission mechanism.

11. The cleaning assembly according to claim 1, wherein the transmission mechanism includes a second gear engaged with the first gear and configured to drive the first gear.

12. The cleaning assembly according to claim 11, wherein the first and second gears are helical gears.

13. The cleaning assembly according to claim 12, wherein the first gear has a first height and the second gear has a second height, and the first height is smaller than the second height.

14. A cleaning robot, comprising:

a main body, and a cleaning assembly disposed in the main body, comprising:

a motor;

a transmission mechanism coupled with the motor; and a cleaning device comprising:

a shaft having a first gear mounted thereon and coupled with the transmission mechanism, the shaft being configured to rotate in response to an output of the transmission mechanism and to move axially, and a cleaning module mounted to an end of the shaft and configured to clean a surface area; and a first limiting structure slidingly engaged with the shaft and configured to limit the axial movement of the shaft in a first axial direction through a first contact with the first gear.

15. The cleaning robot according to claim 14, further comprising a second limiting structure slidingly engaged with the shaft and configured to limit the axial movement of the shaft in a second axial direction through a second contact with the first gear.

16. The cleaning robot according to claim 15, wherein the transmission mechanism is configured to generate one or more rotational outputs, and the shaft is configured to move in at least one of the first axial direction or the second axial direction in response to the one or more rotational outputs of the transmission mechanism.

17. The cleaning robot according to claim 16, wherein the shaft is configured to rotate in a first rotational direction and move in the first axial direction in response to a first rotational output of the transmission mechanism.

18. The cleaning robot according to claim 15, wherein the first and second limiting structures are disposed in a housing of the transmission mechanism.

19. The cleaning robot according to claim 14, wherein the transmission mechanism includes a second gear engaged with the first gear and configured to drive the first gear.

20. The cleaning robot according to claim 19, wherein the first and second gears are helical gears.

* * * * *